US006772657B2

(12) United States Patent
Nakayama

(10) Patent No.: US 6,772,657 B2
(45) Date of Patent: Aug. 10, 2004

(54) NAIL-SETTING CLAW HAMMER HEAD

(76) Inventor: Toshiro Nakayama, 2 Saddlehorn La., Rolling Hills Estates, CA (US) 90274

( * ) Notice: Subject to any disclaimer, the term of this patent is extended or adjusted under 35 U.S.C. 154(b) by 0 days.

(21) Appl. No.: 09/867,387

(22) Filed: May 31, 2001

(65) Prior Publication Data

US 2001/0035072 A1 Nov. 1, 2001

Related U.S. Application Data

(63) Continuation-in-part of application No. 09/313,569, filed on May 3, 1999, now Pat. No. 6,299,136.
(60) Provisional application No. 60/086,181, filed on May 20, 1998.

(51) Int. Cl.[7] ..... B25D 1/00
(52) U.S. Cl. ..... 81/23; 254/26 R
(58) Field of Search ..... 81/20, 23, 44; 254/26 R

(56) References Cited

U.S. PATENT DOCUMENTS

| | | | | | |
|---|---|---|---|---|---|
| 116,553 | A | * | 7/1871 | Cheney | 81/23 |
| 271,709 | A | * | 2/1883 | Hooper | 81/23 |
| 603,228 | A | | 4/1898 | Ashley | 254/26 R |
| 619,608 | A | | 2/1899 | Penny | 81/20 |
| 638,341 | A | | 12/1899 | Knight | 81/26 |
| D35,290 | S | | 11/1901 | MacDERMOTT | 81/20 |
| 834,827 | A | | 10/1906 | Luse | 81/26 |
| 857,104 | A | * | 6/1907 | Parker, Jr. | 254/26 R |
| 1,042,177 | A | | 10/1912 | Vredenburg | 254/26 R |
| 1,052,965 | A | * | 2/1913 | Riddle | 81/23 |
| 1,103,380 | A | * | 7/1914 | Renton | 81/23 |
| 1,159,583 | A | | 11/1915 | Haight | 81/20 |
| 1,201,171 | A | | 10/1916 | Grant | 254/26 R |
| 1,209,583 | A | * | 12/1916 | Holmdahl | 254/26 R |
| D82,402 | S | | 10/1930 | Whitford | 254/26 R |
| 1,934,706 | A | | 11/1933 | Green | 81/23 |
| 1,957,760 | A | | 5/1934 | Cownie | 254/26 R |
| D140,821 | S | | 4/1945 | MacWITHEY | 254/26 R |
| 2,420,120 | A | | 5/1947 | Bruchsaler | 87/20 |
| 3,578,825 | A | | 5/1971 | Merrow et al. | 81/20 |
| 4,193,433 | A | | 3/1980 | Sickler | 81/23 |
| 4,290,583 | A | | 9/1981 | Lombardi | 81/20 |
| 4,718,313 | A | | 1/1988 | Yamaguchi | 81/23 |
| 4,732,058 | A | * | 3/1988 | Chung | 81/20 |
| 5,159,858 | A | | 11/1992 | Gansen | 81/23 |
| 5,280,738 | A | | 1/1994 | Liou | 81/20 |

FOREIGN PATENT DOCUMENTS

| | | |
|---|---|---|
| IT | 524002 | 4/1955 |

* cited by examiner

*Primary Examiner*—James G. Smith
(74) *Attorney, Agent, or Firm*—Rader, Fishman & Grauer PLLC

(57) ABSTRACT

A nail-setting claw hammer head includes a main body and a claw. The main body has a top surface and a rear surface with the rear surface including a nail-head receiving recess formed therein. The claw is connected to the rear surface at one end and terminates at an opposite second end with a pair of claw sections that define a V-shaped slot therebetween. The nail-head receiving recess is positioned to face the V-shaped slot and is in a plane defined by horizontal and vertical axes of the main body.

10 Claims, 6 Drawing Sheets

Fig.13
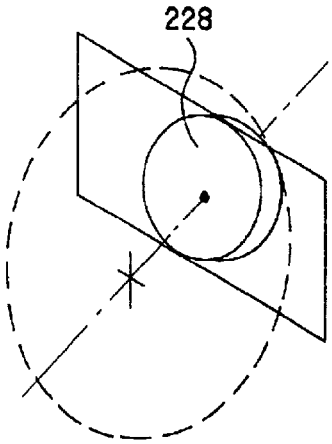
Fig.12
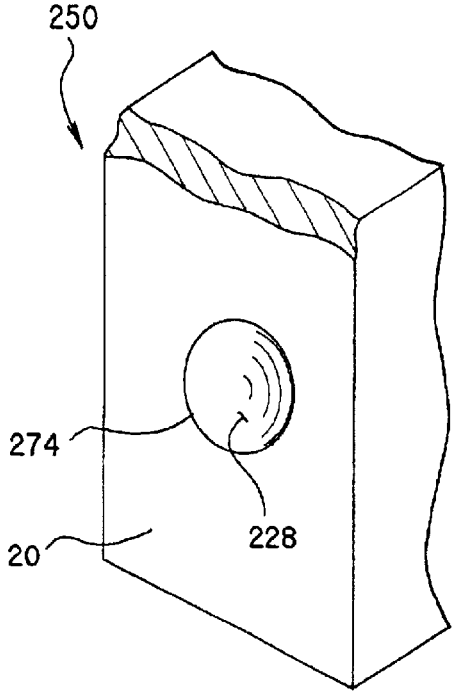
Fig.15
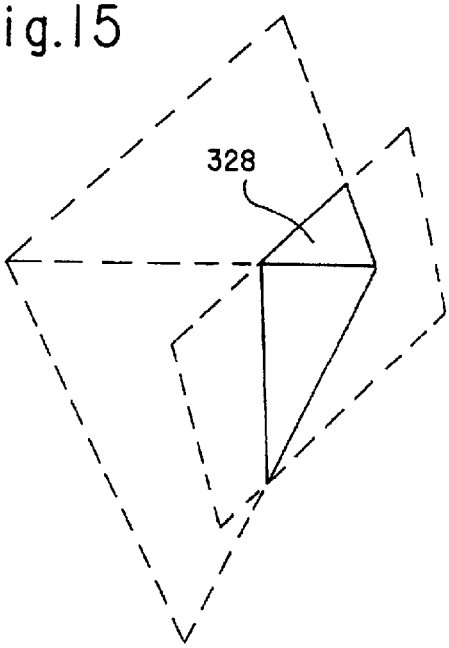
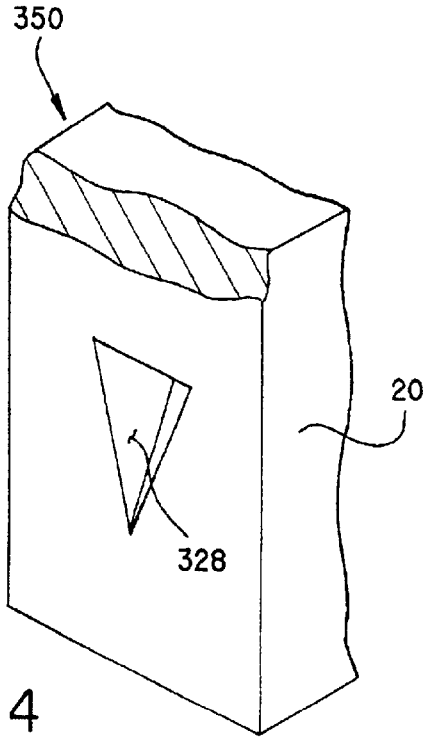
Fig.14

NAIL-SETTING CLAW HAMMER HEAD

This application claims the benefit of U.S. Provisional Application No. 60/086,181, filed May 20, 1998 and U.S. Non-Provisional Application Serial No. 09/313,569 filed May 3, 1999. This application is a Continuation-In-Part of U.S. Non-Provisional application Ser. No. 09/313,569 filed May 3, 1999, now U.S. Pat. No. 6,299,136.

BACKGROUND OF THE INVENTION

The present invention relates to a claw hammer head and, more specifically, an improved claw hammer head having a high brow and multi-radiused claw with tapered, pointed claw tips and a very sharp V slot.

In order to keep the terminology that is used in this patent clear, the following definitions are used throughout the specification and claims:

The Head is defined as the object attached to the end of the handle, used to strike the nail. The Face is defined as the surface of the "head" traditionally used to strike the nail. The Body is defined as the main portion of metal on which the rest of the hammer is formed. The Neck is defined as the part of the head between the face and the body. The Socket is defined as the longitudinal hole in the body material in which the end of the handle is inserted and fixed in the usual manner by one or more wedges. The Side-hitter is defined as the "face" on the side of the body used for hitting nails in tight places. The Claw is defined as the part of the head used to remove a nail from wood. The Slot is defined as the area in the claw in which the shank of the nail is gripped to remove the nail from the wood. The Rocker is defined as the longitudinal curvature of the surface of the claw that bears against the wood. The Roll is defined as the lateral curvature of the surface of the claw that bears against the wood. The Brow is defined as the top of the body including the socket adjoining the rocker. The Pocket is defined as the area of the head between the interior surface of the claw and rear face of the body of the head. The Cup is defined as a small indentation on the rear surface of the body at a position roughly in line with a initial opening of the slot or throat adjacent the tips of the claw. Spiking is defined as the act of starting a nail in the wood, using only the hammer head to hold the nail.

Claw hammer heads have been long known in the art. Generally, the heads have a low brow with a uniform radius curved claw on one side and a short neck with flat face on the other side. These conventional hammer heads, with a low brow (from top to top edge of face being on the order of ¼ to 5/16") is designed to pull 1 ½" nails. Additionally, with conventional hammer heads having a low brow, at close to limit of travel during nail pull rotation, the top edge of the face can and often does contact the wood, (dents and dings) which is especially undesirable if doing finishing work in expensive hard woods. The claw generally has square end, blunt, chisel-like tips and a relatively broad V slot for pulling nails. The neck of a conventional hammer head is only about 1 ¾". The face is flat and parallel with the centerline of the handle of the hammer.

SUMMARY AND OBJECTS OF THE INVENTION

It is an object of the present invention to provide a claw hammer especially suitable for easily pulling long nails with much less pulling power.

It is another object of the present invention to provide a claw hammer better adapted for pulling small head finishing nails and even "headless" nails.

It is yet another object of the present invention to provide a claw hammer with the ability to remove embedded nails with the specially designed claw.

It is yet a further object of the present invention to provide a claw hammer better adapted for spiking.

It is yet another object of the present invention to provide a claw hammer head that enables a user to more easily spike a conventional nail in a workpiece.

The high-brow head combined with a progressive radius claw curve reduces the force needed to only a few pounds over the entire arc of nail pulling rotation. The claw tips are pointed, enabling the claw to dig under nail heads that are below the wood surface. The claw has a very sharp V throat which can dig right into the shank of the nail, for pulling out a nail with an additional leverage or for spiking. The wedging effect in the slot keeps the nail from moving sideways while the contoured cup holds the head of the nail securely to prevent turning of the nail about the pivot at the slot.

BRIEF DESCRIPTION OF THE DRAWINGS

The above and other objects and the attendant advantages of the present invention will become readily apparent by reference to the following detailed description when considered in conjunction with the accompanying drawings wherein:

FIG. 12 is a partial rear perspective view of a third embodiment of the main body having a partial hemispherically-shaped nail-head receiving recess formed into the rear surface thereof.

FIG. 13 is an imaginary sphere divided by a plane to further illustrate the configuration of the partially hemispherically-shaped nail-head receiving recess in FIG. 12.

FIG. 14 is a partial rear perspective view of a fourth embodiment of the main body with a partial pyramidally-shaped nail-head receiving recess formed into the rear surface thereof.

FIG. 15 is an imaginary pyramid divided by a plane to further illustrate the configuration of the partial pyramidally-shaped nail-head receiving recess in FIG. 14.

DETAILED DESCRIPTION OF A PREFERRED EMBODIMENT

Figure 3:
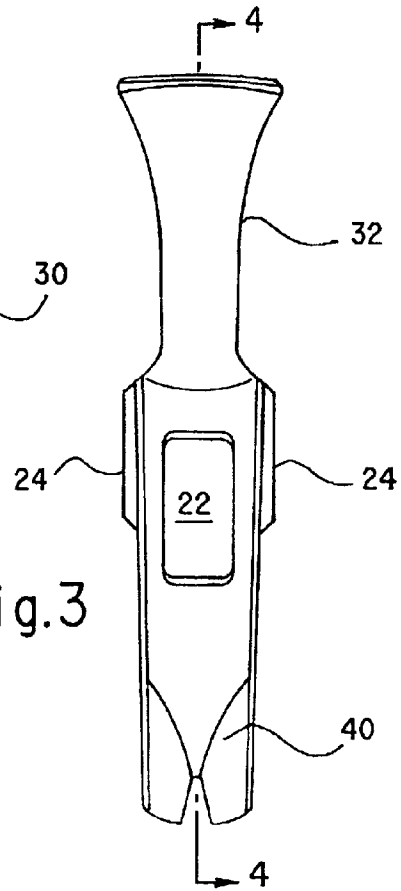
FIG. 3 is a top view of the present invention.
Figure 1:
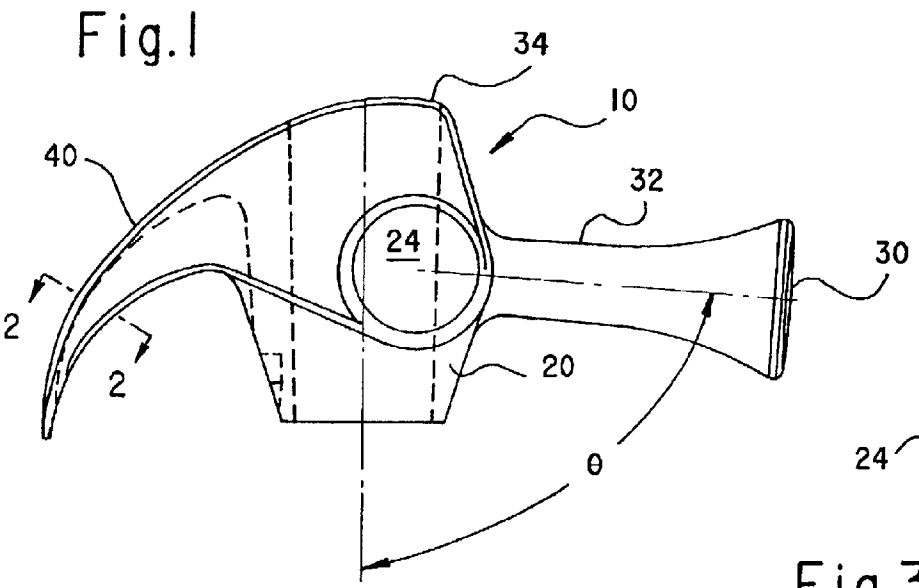
FIG. 1 is a side view of one embodiment of the present invention.
Figure 2:
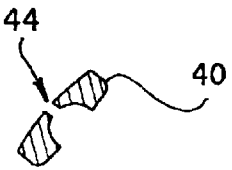
FIG. 2 is a cross-sectional view taken along line 2—2 in FIG. 1.
Figure 5:
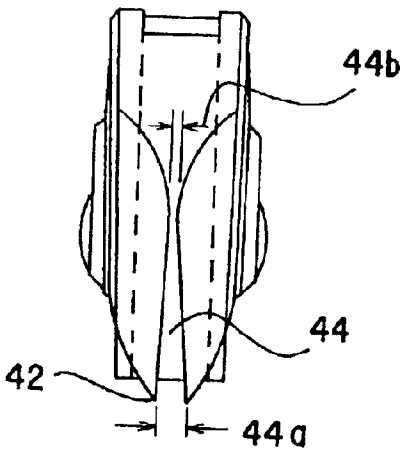
FIG. 5 is a rear view of the present invention.
Figure 4:
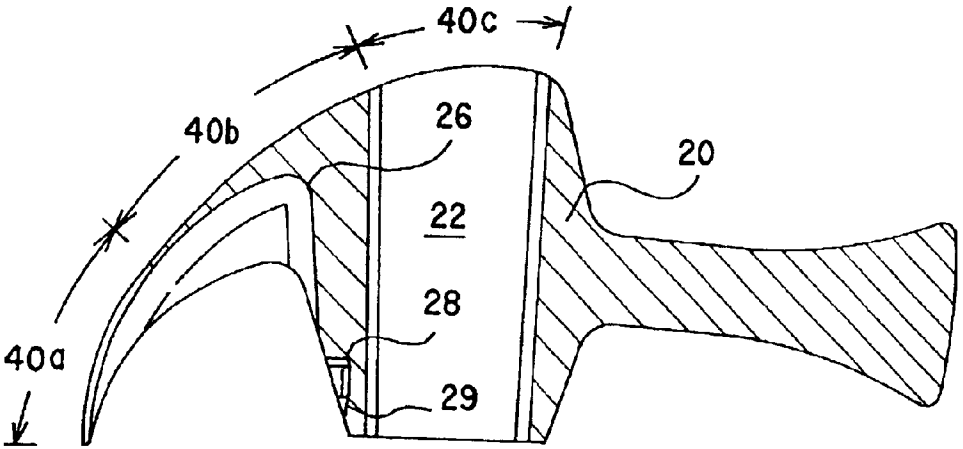
FIG. 4 is a cross-sectional view taken along line 4—4 in FIG. 3.

The present invention is a claw hammer head 10 having a main body or body 20, a neck 32 extending from the front of the body 20 and having a face 30, and a claw 40 extending from the back of the body 10. The head 10 is made, for example, of alloy steel and has the conventional socket 22 for mounting the head 10 on a wood or fiberglass handle (not shown) in the conventional manner using wedges or epoxy.

The head 10 has a high raised brow 34. The high brow 34, combined with a progressive radius claw rocker or curve (discussed below), easily pulls the full length of a 3.5"× 0.162", 16D common nail before contact is made with the top of the hammer face 30. The distance between top of brow 34 and top surface (edge) of the neck 32 is about ⅞". This high brow 34 ensures a flat and stable fulcrum surface as the claw 40 is rotated through the critical portion of its 93 degrees of travel during nail pull rotation. This high brow 34 also allows additional # degrees of travel of the head 10 during nail pull rotation. This also eliminated an unstable "pivot" pull (pivoting in the hammer face), as is typical with all other hammer models commercially available.

The multi-radius claw 40 has a profile which maximizes hand-pull leverage during the entire scope of a nail pull rotation. The first rocker portion 40*a* (to begin the nail pull rotation) at the end of the claw near the tips 42 has a small radius, for example, 2.0"R. This creates a large leverage ratio, allowing for easy initial extraction of the nail (only a few pounds of push needed by user). The radius changes at the second rocker portion 40*b* in middle portion of the claw 40 to a larger radius, for example, 3.75"R. The third rocker portion 40*c* has a finish radius at and adjacent the brow which returns to a smaller radius, for example, 2.00"R. The substantially flat outer surface (roll of a 2.00'R) (across the width) of the claw 40 gives added stability during the rotation of the claw 40.

The claw tips 42 are tapered and pointed, enabling the claw 40 to dig under nail heads that are below the wood surface. With claw tips 42 positioned at the sides of the nail to be pulled, hitting the face 30 of the head 10 with another hammer drives the claw tips 42 into the wood until the edges of the slot 44 bite into the shank of the nail. The present inventive hammer head 10 is also designed to pull nails without a head. The claw 40 has a very sharp V slot 44 (for example, a width 44*a* adjacent the tips of 0.22", a width 44*b* at top of wedge slot of 0.05", a length of the slot of 1.28") which can dig right into the shank of the nail, pulling out the nail with an additional leverage. This even enables pulling of deep set finishing nails or "headless" nails. Most conventional hammers have square end, blunt, chisel-like tips and a relatively broad V slot.

The head 10 is provided with a nail-head receiving recess or cup 28 in the pocket 26 which is used to hold the nail head when one handed spiking with the nail positioned with the head of the nail in the cup 28 and the shank in the slot 44 captured by the V shape of the slot 44. The wedging effect in the slot 44 keeps the nail from moving sideways while the contoured cup 28 holds the head of the nail securely to prevent turning of the nail about the pivot at the slot 44. The contoured cup surface 29 is slightly curved such that the nail is held securely without wobble yet when the nail strikes its surface (to be nailed during a one hand spike), the nail disengages from the cup 28 and is freed from the claw 40 (dislodged by shock). Then in typical fashion, the nail is pounded in using the hammer face 30. The inside of pocket 26 on claw side can be hollowed, with flanges on claw 40 extending inwardly toward body 20.

The present invention has a long reach neck 32 (for example, 2.35") which is designed to reach over a 2×4 stud, to an obscured nail on the far side of the 2×4 stud. This hammer head design has an overstrike capability of 2 inches. A neck of a conventional hammer head is 1 ¾" or less.

The progressive radius neck 32 (shaped like a trumpet) dampens and distributes impact forces to minimize impact shock to the user's hand, wrist and elbow. Initial face 30 diameter can be 1.25" with the neck diameter adjacent joining of body being 0.60". The progressive flare portion of the neck 32 has radius adjacent the face 30 of 3.5"R merging with cylindrical portion to the body 20. This allows for the full weight force to be focussed at the entire surface of the hammer head where the head strikes the target (even if nail is hit close to face edge, the same force is provided.) The force goes to edges of face. The neck is angled at θ=86 degrees measured downwardly relative to the centerline of the hammer handle, forming an acute angle (less than 90 degrees). This acute angle ensures that the hammer face strikes the nail head with a positive hooking action, making a more efficient strike (force used/nail penetration). The angle of the head surface (where it hits the nail) and end of hammer provides a natural accommodation to the wrist of the user and maximizes the depth of the hit which results in the nail being driven deeper and faster for each strike.

The oversized hammer face 30 (25% larger than conventional) gives a larger sweet spot for more accurate and efficient nail striking. The face 30 is slightly contoured to about equal to a 6" R. This causes the force to follow the contour which maximizes efficient area of hitting. The edge of the face 30 is chamfered. The particular design gives additional driving force, due in part to longer contact.

The large side hitting faces 24 on each side of the body 20 of the head 10 allows hammer accessibility to tight areas. The side hitter 24 is located almost at the CG of the hammer's head, eliminating unwanted side torque. This feature is used in tight places, for example, between studs when installing electrical boxes.

As discussed above, the claw hammer head includes a nail-head receiving recess or cup 28 that is used to hold a nail head for one-handed spiking. The nail-head receiving recess 28 has been illustrated with the claw hammer head 10 of the first embodiment of the present invention. However, the nail-head receiving recess 28 can be used with other claw hammer heads, i.e., claw hammer heads without a high raised brow, ripping hammer heads, framing hammer heads and the like.

Thus, other types of claw hammer heads can be adapted as a nail-setting claw hammer head in accordance with the present invention.

Figure 7:
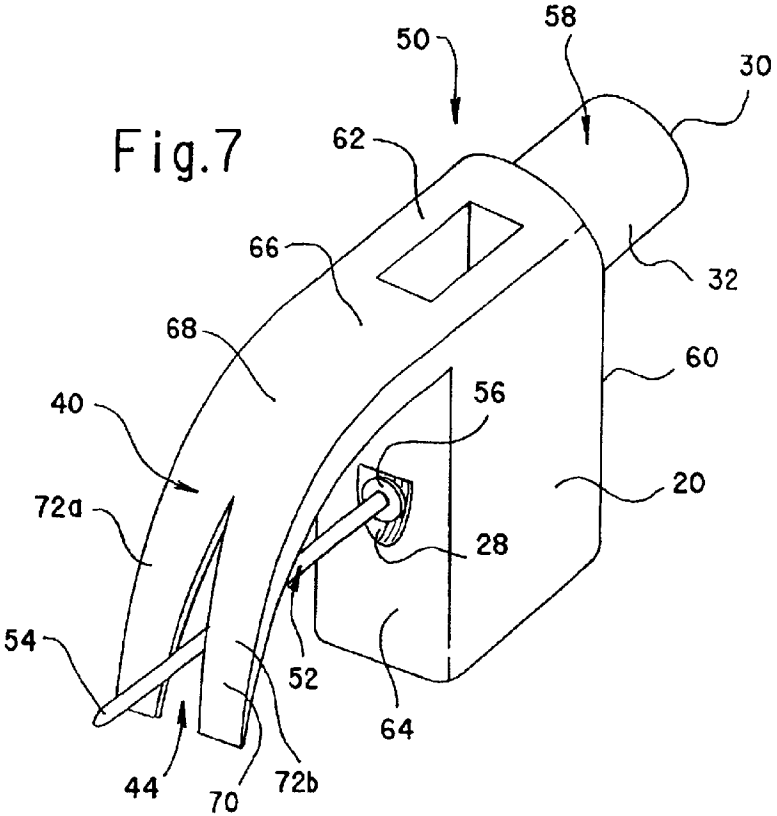
FIG. 7 is a rear perspective view of the hammer head shown in FIG. 6 retaining a conventional nail in preparation for the nail to be set in a workpiece.

A first embodiment of a nail-setting claw hammer head 50 is introduced in FIGS. 6–9. The nail-setting claw hammer head 50 of the invention holds a conventional nail 52 (FIG. 7). The nail 52 has a shank portion 54 and a head portion 56. The nail-setting claw hammer head 50 of the present invention includes the main body 20, an impact member 58 and the claw 40.

Figure 6:
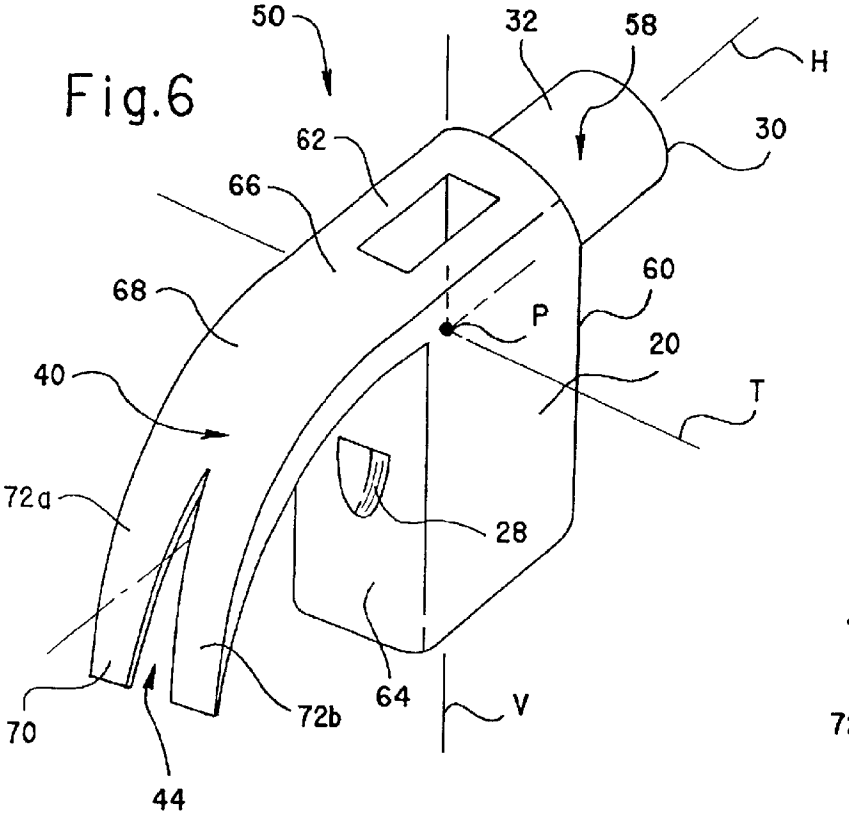
FIG. 6 is a rear perspective view of another hammer head having an inventive feature of the present invention.

The main body 20, as best shown in FIG. 6, is disposed along and about a horizontal axis H, a vertical axis V and a transverse axis T. The horizontal H, the vertical axis V and the transverse axis T intersect one another perpendicularly at a point of intersection P interiorly of the nail-setting claw hammer head 50 to define a center of mass. The main body 20 has a front surface 60, a top surface 62 and a rear surface 64. Also, the rear surface 64 includes the nail-head receiving recess 28 which is formed therein.

The impact member 58 connects to and projects from the front surface 60 as is commonly known in the art. The impact member includes the neck 32 and the hammer face 30.

As best shown in FIGS. 6 and 7, the claw 40 is connected to the rear surface 64 of the main body 20. Specifically, the claw 40 is connected to the rear surface 64 at a first end 66 such that the claw 40 and the top surface 62 form a fulcrum surface 68. The claw 40 curves about the point of intersection P and is disposed apart from the rear surface 64. The claw 40 also has a second end 70 that is disposed opposite the first end 66. The claw 40 terminates at the second end 70 with a pair of claw sections 72*a* and 72*b*. The pair of claw sections, 72*a* and 72*b*, define the V-shaped slot 44 which is discussed above.

The nail-head receiving recess 28 is positioned to face the V-shaped slot 44. The nail-head receiving recess 28 is sized and adapted to receiving the nail head portion 56 of the nail 52. Further, the V-shaped slot 44 is sized and adapted to receive the shank portion 54 of the nail 52. Thus, when the nail-head receiving recess 28 receives the nail head portion 56 of the nail 52 and the V-shaped slot 44 receives the shank portion 54 of the nail, the shank portion 54 of the nail 52 is wedged into the V-shaped slot 44. As shown in FIG. 7, the nail 52 is prepared to be set into a workpiece by a user.

Figure 8:
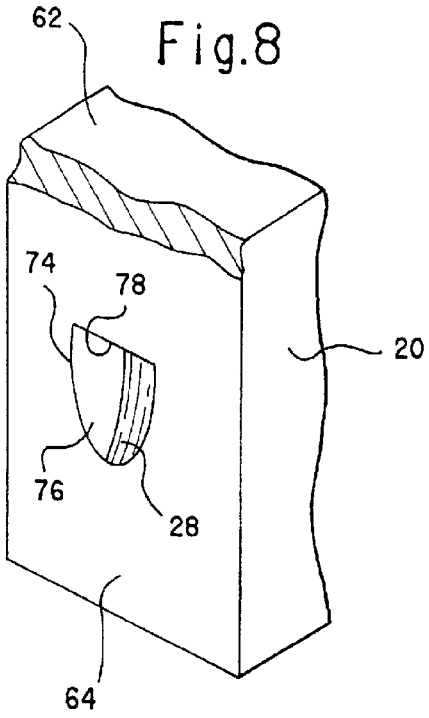
FIG. 8 is a partial perspective view of a main body of the nail-setting claw hammer head with a partially conically-shaped nail-head receiving recess formed therein.

As best shown in FIG. 8, the nail-head receiving recess 28 is defined by an opening 74 that surrounds the nail-head receiving recess 28 and is flush with the rear surface 64. In all of the embodiments, the cup or nail-head receiving recess progressively deepens and is defined at least in part by a non-flat surface. Thus the head of the nail held in the cup goes to the deepest level it can and is held from lateral movement.

Figure 9:
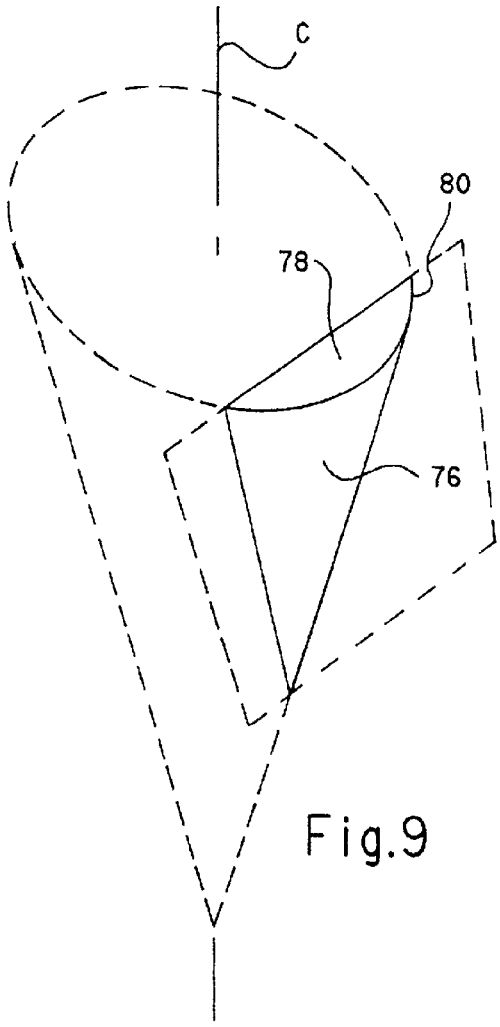
FIG. 9 is a perspective view of an imaginary cone divided by a plane to more particularly illustrate the shape of the nail-head receiving recess in FIG. 8.
Figure 16:
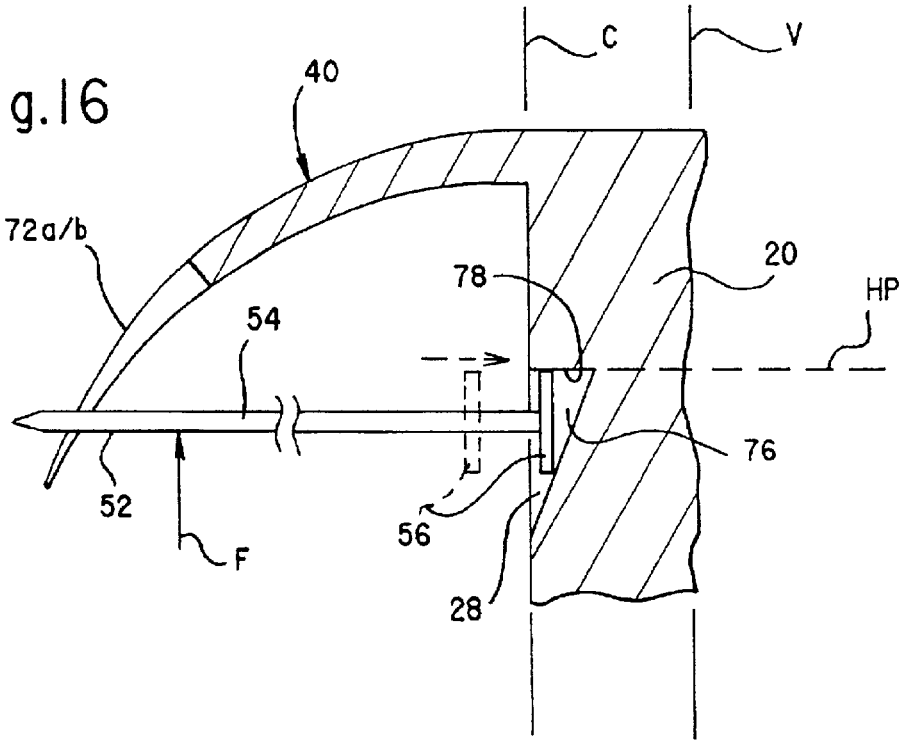
FIG. 16 is a partial side cross-sectional view of the nail-setting claw hammer head retaining a conventional nail.

One of ordinary skill in the art would appreciate that the nail-head receiving recess 28 can be configured in a variety of shapes. However, it is preferred that the first embodiment of the nail-setting claw hammer head 50 of the invention has a partially conically-shaped configuration as best shown in FIGS. 8, 9 and 16. FIG. 9 illustrates pictorially what is meant by a partially conically-shaped nail-head receiving recess. More particularly, the nail-head receiving recess 28 includes a curved surface 76 and a flat surface 78. The curved surface 76 curves generally about a conical axis C (FIGS. 9 and 16) which extends generally parallel with the vertical axis V. The flat surface 78 intersects the curved surface 76 along a curved edge 80, from a vertical perspective along the vertical axis V. The flat surface 78 is disposed between the curved surface 76 and the point of intersection P. In other words, the flat surface 78 is positioned closer to the top surface 62 of the nail-setting claw hammer head 50 of the invention. This provides a inverse ramp like void which progressively becomes wider and deeper. The head of the nail is held at the deepest position possible in a wedging like effect.

Figure 10:
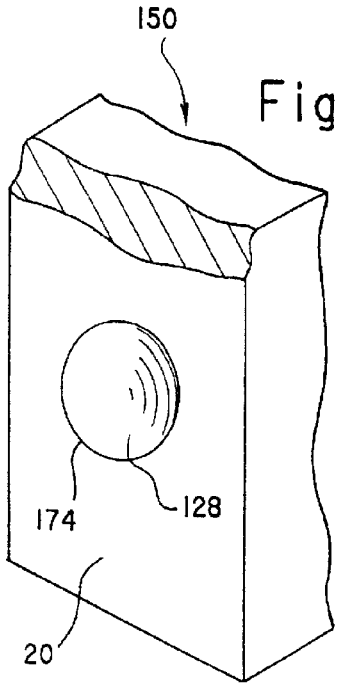
FIG. 10 is a partial rear perspective view of the main body having a nail-head receiving recess being hemispherically shaped.
Figure 11:
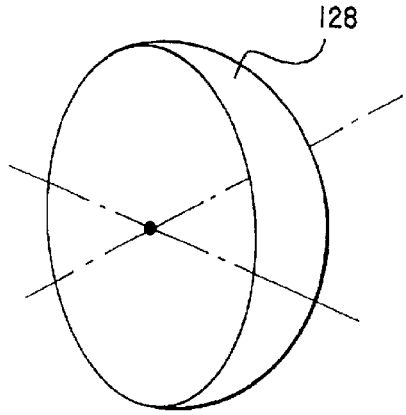
FIG. 11 is an imaginary sphere divided by a plane to further illustrate the hemispherically-shaped nail-head receiving recess in FIG. 10.

A second embodiment of a nail-setting claw hammer head 150 is shown in FIGS. 10 and 11. The second embodiment of the nail-setting claw hammer head 150 of the invention is identical to the first embodiment of the nail-setting claw hammer head 50 of the invention except for the configuration of the nail-head receiving recess 128. The second exemplary embodiment of the nail-setting claw hammer head 150 of the invention has a hemispherically-shaped nail-head receiving recess 129. As a result, its opening 174 is circular. This provides a progressively deepening void in which the head of the nail is held at the deepest position possible and where the head of the nail will be self-centered with no lateral movement possible.

A third exemplary embodiment of a nail-setting claw hammer head 250 of the invention is introduced in FIGS. 12 and 13. The third exemplary embodiment of the nail-setting claw hammer head 250 is similar to the first and second exemplary embodiments of a nail-setting claw hammer head of the invention. The only difference is the configuration of the nail-head receiving recess 228. The nail-head receiving recess 228 is partially hemispherically-shaped. The intent and meaning of "partially hemispherically-shaped" is illustrated in FIG. 13 by a plane that divides an imaginary sphere with the plane being apart from the spherical center. Further, one of ordinary skill in the art would appreciate that its opening 274 is circular. This exemplary embodiment operates in much the same manner as the second exemplary embodiment.

A fourth exemplary embodiment of a nail-setting claw hammer head 350 of the invention is introduced in FIGS. 14 and 15. The fourth exemplary embodiment of the nail-setting claw hammer head 350 of the invention is similar to the exemplary embodiments described above. The only difference is the configuration of the nail-head receiving recess 328. The nail-head receiving recess 328 is partially pyramidally shaped. The intent and meaning of "partially pyramidally shaped" is illustrated in FIG. 15 whereby a plane divides an imaginary pyramid. This provides a inverse ramp like void which progressively becomes wider and deeper similar to the first described embodiment. The head of the nail is held at the deepest position possible in a wedging like effect.

In FIG. 16, a nail 52 is shown in relationship with the claw 40 and the nail-head receiving recess 28. Note, the head 56 of the nail 52 is moved generally in a horizontal direction away from the claw sections 72*a* and 72*b*. Once the head portion 56 of the nail 52 is received within the nail-head receiving recess 28, a force F is applied to the nail 52 in a direction towards the top surface 62 in order to wedge the shank portion 54 of the nail 52 into the V-shaped slot 44. Although the nail 52 is illustrated horizontally, one of ordinary skill in the art would appreciate that the nail 52 in a nail-setting state can be positioned offset from the horizontal position, i.e., angularly relative to the head 56 in the recess. It is preferred that the longitudinal axis of the nail be substantially parallel to the horizontal axis H and substantially perpendicular to the lateral axis T and the vertical axis V of the main body.

As noted above, the present invention can be embodied in many types of claw hammer heads. In different style heads, the vertical positioning of the nail-head receiving recess on the rear face can vary and is positioned relative to the curvature of the claw so that the longitudinal axis of the nail is substantially parallel to the horizontal axis H and substantially perpendicular to the lateral axis T and the vertical axis V of the main body when the nail is held by the V-shaped slot in the claw and the nail-head receiving recess. That is, the nail-head receiving recess can be centrally located on the rear surface in a claw hammer head having a moderately curved claw and can be higher up the rear face for a flatter curved claw hammer such as a framing hammer. The less curvature of the claw the higher on the rear face the nail-head receiving recess is positioned and, conversely, the more curvature of the claw, the lower on the rear face the nail-head receiving recess is positioned. The position will rise as the claw is closer to straight (as in a framing hammer).

Figure 17:
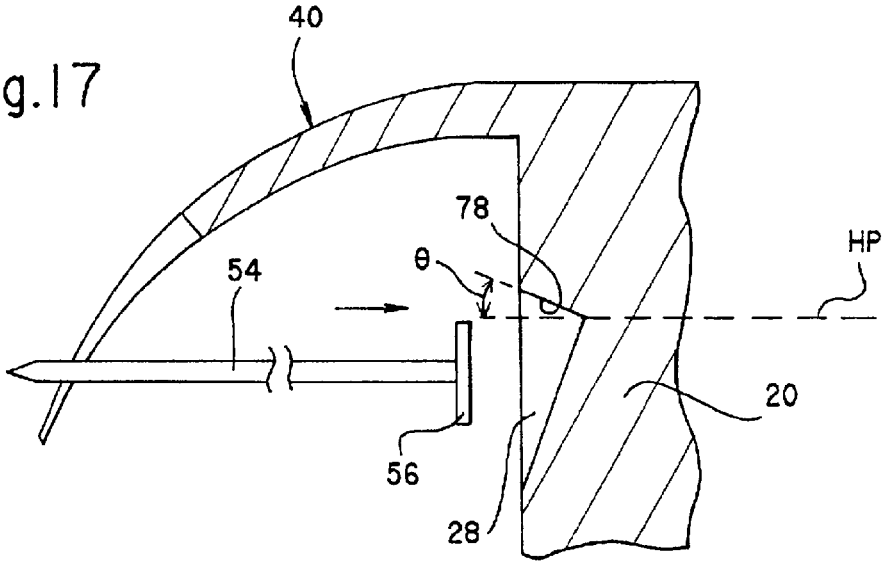
FIG. 17 is a partial side cross-sectional view of the nail-setting claw hammer head illustrating the nail-head receiving recess having a top flat surface formed at an angle.

In FIG. 16, the flat surface 78 extends generally horizontally in a horizontal plane HP. However, in FIG. 17, the flat surface 78 deviates from the horizontal plane HP. Preferably, the flat surface 78 is oriented relative to the horizontal plane HP at an angle e in a range of 0.5° and 10°. Further, the flat surface 78 is oriented such that as the flat surface 78 continues interiorly into the nail-head receiving recess 28, the flat surface 78 extends away from the point of intersection P as viewed exteriorly of the nail-head receiving recess 28.

The present invention is readily useable with and sized for almost all commercially available nails. It is especially suited for common nails and finishing nails. The wedging effect of the shank of the nail in the V-shaped slot of the claw and of the head in the nail receiving recess prevents the nail from slipping or sliding and enables one handed spiking.

It is readily apparent that the above-described has the advantage of wide commercial utility. It should be understood that the specific form of the invention hereinabove described is intended to be representative only, as certain modifications within the scope of these teachings will be apparent to those skilled in the art. Particularly, a skilled artisan would appreciate that the sizes and configurations of the recesses described above are shown by way of example only and that other sizes and other configurations of recesses can be used to implement the present invention.

What is claimed is:

1. A nail-setting claw hammer head, comprising:

a main body disposed along and about a horizontal axis, a vertical axis and a transverse axis which intersect one another perpendicularly at a point of intersection to define a center of mass, the main body having a top surface and a rear surface with the rear surface including a nail-head receiving recess formed therein; and a claw connected to the rear surface of the main body at a first end and forming a fulcrum surface with the top surface, the claw curving about the point of intersection and disposed apart from the rear surface, the claw terminating at a second end opposite the first end with a pair of claw sections defining a V-shaped slot therebetween, the nail-head receiving recess being positioned to face the V-shaped slot, wherein the nail-head receiving recess has a curved surface extending into the rear surface of the main body and curving about a conical axis extending generally parallel with the vertical axis and a flat surface intersecting the curved surface and the flat surface is disposed between the curved surface and the point of intersection.

2. A nail-setting claw hammer head according to claim 1, wherein the flat surface extends in a horizontal plane.

3. A nail-setting claw hammer head according to claim 1, wherein the flat surface is oriented relative to a horizontal plane at an angle in a range of 0.5 degrees and 10 degrees.

4. A nail-setting claw hammer head according to claim 1, wherein the flat surface is oriented to extend away from the point of intersection as viewed exteriorly of the nail-head receiving recess as the flat surface extends into the nail-head receiving recess.

5. A nail-setting claw hammer head according to claim 1, wherein the nail-head receiving recess defines an opening on and into the rear surface of the main body.

6. A nail-setting claw hammer head for holding a conventional nail having a shank portion and a nail head portion connected to the shank portion, the nail-setting claw hammer head comprising:

a main body disposed along and about a horizontal axis, a vertical axis and a transverse axis which intersect one another perpendicularly at a point of intersection to define a center of mass, the main body having a front surface, a top surface and a rear surface with the rear surface including a nail-head receiving recess formed and defined by a nail-head receiving recess surface extending into the rear surface of the main body;

an impact member connected to and projecting from the front surface, the impact member having a neck and a hammer face; and a claw connected to the rear surface of the main body at a first end and forming a fulcrum surface with the top surface, the claw curving about the point of intersection and disposed apart from the rear surface, the claw terminating at a second end opposite the first end with a pair of claw sections defining a V-shaped slot therebetween, the nail-head receiving recess positioned to face the V-shaped slot such that the nail-head receiving recess is sized and adapted to receive the nail head portion of the nail and the V-shaped slot is sized and adapted to receive the shank portion of the nail in order to wedge the shank portion therein, wherein the nail-head receiving recess surface has a curved surface portion curving about a conical axis extending generally parallel with the vertical axis and a flat surface portion intersecting the curved surface portion.

7. A nail-setting claw hammer head according to claim 6, wherein the flat surface is disposed between the curved surface and the point of intersection.

8. A nail-setting claw hammer head according to claim 7, wherein the flat surface extends in a horizontal plane.

9. A nail-setting claw hammer head according to claim 7, wherein the flat surface is oriented relative to a horizontal plane at an angle in a range of 0.5 degrees and 10 degrees.

10. A nail-setting claw hammer head according to claim 9, wherein the flat surface is oriented to extend away from the point of intersection as viewed exteriorly of the nail-head receiving recess as the flat surface extends into the nail-head receiving recess.

* * * * *